United States Patent [19]

Barbee

[11] Patent Number: 4,589,267

[45] Date of Patent: May 20, 1986

[54] METHOD AND APPARATUS FOR PRODUCING HOSIERY ARTICLE

[75] Inventor: Jack C. Barbee, Gastonia, N.C.

[73] Assignee: Speizman Industries, Inc., Charlotte, N.C.

[21] Appl. No.: 650,972

[22] Filed: Sep. 13, 1984

Related U.S. Application Data

[63] Continuation of Ser. No. 438,407, Nov. 1, 1982, abandoned.

[51] Int. Cl.[4] ..... D04B 9/12; D04B 9/56

[52] U.S. Cl. ..... 66/12; 66/42 A; 66/187; 66/194; 66/201

[58] Field of Search ..... 66/42 A, 191, 194, 201, 66/9 R, 43, 107, 178 R, 182, 185, 186, 187, 12

[56] References Cited

U.S. PATENT DOCUMENTS

| | | | |
|---|---|---|---|
| 2,116,358 | 5/1938 | Leedham et al. | 66/93 X |
| 2,148,622 | 2/1939 | Horrocks | 66/93 |
| 2,375,684 | 5/1945 | Page | 66/185 |
| 2,550,880 | 5/1951 | St. Pierre | 66/201 |
| 3,241,340 | 3/1966 | Knohl | 66/185 |
| 3,425,246 | 2/1969 | Knohl | 66/185 X |
| 3,546,900 | 12/1970 | Knohl | 66/185 |
| 3,603,116 | 9/1971 | Turini | 66/187 |
| 4,038,699 | 8/1977 | Burn | 66/178 R |
| 4,237,707 | 12/1980 | Safrit et al. | 66/185 X |

FOREIGN PATENT DOCUMENTS

| | | | |
|---|---|---|---|
| 43135 | 1/1982 | European Pat. Off. | 66/93 |
| 1414356 | 9/1965 | France | 66/201 |

*Primary Examiner*—Wm. Carter Reynolds

*Attorney, Agent, or Firm*—Shefte, Pinckney & Sawyer

[57] ABSTRACT

A hosiery knitting method and apparatus wherein contoured terry-type heel and toe areas are circularly knit on a four station hosiery machine by arranging one station to knit complete terry courses on all needles and sinkers and arranging the other three stations to knit partial terry courses on only a group of selected successive needles and associated sinkers. To insure proper plating for terry knitting when reintroducing the yarns at the three other stations, a number of needles preceding and succeeding the needles selected to knit are operated to tuck the base yarn to constrain it onto the lower sinker surface.

26 Claims, 7 Drawing Figures

METHOD AND APPARATUS FOR PRODUCING HOSIERY ARTICLE

CROSS REFERENCE TO RELATED APPLICATION

This application is a continuation of co-pending application Ser. No. 438,409, filed Nov. 1, 1982, now abandoned.

BACKGROUND OF THE INVENTION

The present invention relates to circular hosiery knitting machines, the methods of knitting employed thereby, and the articles produced thereon and particularly to hosiery articles of the terry-knit cushion sole type and the machines and methods for knitting same.

In the circular knitting of hosiery articles, it is known to knit the foot portion, and sometimes also a part of the leg portion, of a terry knit construction of plated pile and base yarns which produces a thicker fabric having uncut pile loops to provide a cushioning effect when worn, this type of construction generally being referred to as cushion sole construction. Cushion sole construction finds its greatest applicability in the knitting of athletic and similar type socks in which the cushioning effect provided is most desirable and needed. As will be understood, cushion sole knitting is somewhat more costly than ordinary non-plated hosiery knitting operations due to the greater amount and attendant cost of yarn required and the somewhat slower plated knitting process. It is additionally known and desirable to produce contoured heel and toe areas in the foot portions of such athletic socks to enhance the fit and protection to the wearer thereof. Such heel and toe areas are typically knitted conventionally by a reciprocal knitting process wherein, during the knitting of each individual sock, the rotary motion of the needle cylinder of the knitting machine is temporarily interrupted at a selected appropriate time and the cylinder is reciprocated during such time to knit with the needles on one circumferential half thereof thereby to knit partial courses to provide an increased number of courses along one side of the sock to impose a curvature therealong. This operation is also a relatively costly one in that it requires special machine preparation and further is slower than the circular, rotary knitting motion of the needle cylinder.

Recently, athletic socks having no knitted heel or toe contours, generally referred to as "tube" socks, have come into popularity because of the reduction in production and attendant consumer costs which result from the elimination of the reciprocal heel and toe knitting operation. However, as will be understood, a less desirable fit is provided with such tube socks which is only partially compensated by the provision of elasticity in the foot portion thereof.

It is known in the knitting of non-terry hosiery articles to knit contoured portions by rotary knitting through the use of multiple knitting stations at least some of which are arranged to operate to knit on only certain successive needles to form the desired partial courses, but this procedure is not known to have been successfully applied to terry-type cusion sole knitting due to problems in insuring the proper plating of the base and pile yarns when knitting on only certain needles.

In contrast, the present invention provides a novel method and apparatus for knitting contoured heel and toe portions in terry knit cushion sole socks by a rotary rather than reciprocal motion of the needle cylinder which produces contoured portions comparable to reciprocal knitting operations while insuring proper plating, thereby providing significant time and cost savings thereover.

SUMMARY OF THE INVENTION

Briefly described, the present invention provides an improvement in a circular hosiery knitting method and in a circular hosiery knitting machine wherein a contoured terry knit portion may be knit in a hosiery article by circularly forming certain complete terry fabric courses and certain partial terry fabric courses along one circumferential portion of the hosiery article to create a greater fabric extent therealong than along the remaining circumferential portion of the hosiery article to impose a fabric curvature that forms the contoured portion. The method and apparatus are of the types employing respective circles of cooperatively-movable, associated knitting needles and sinkers, each complete terry fabric course being formed by knitting a base yarn and a pile yarn in plated relationship on substantially all needles and sinkers and each partial terry fabric course being formed by tucking another base yarn on at least one needle and knitting another base yarn and another pile yarn in plated relationship only on selected needles substantially successively following the one needle and on associated sinkers.

In the preferred embodiment, the at least one needle on which tucking occurs comprises plural successive needles and the selected needles comprise approximately onehalf of the needle circle. Preferably, another partial terry fabric course is formed following each first-described partial terry fabric course and a third partial terry fabric course is formed following each another partial terry fabric course. Each another partial terry fabric course is formed by tucking a third base yarn on selected leading ones of the plural tucking needles and knitting the third base yarn and a third pile yarn in plated relationship on the remaining needles of the plural tucking needles and sinkers associated therewith and on the selected needles and their associated sinkers. Similarly, each third partial terry fabric course is formed by tucking a fourth base yarn on the selected leading tucking needles as well as additional successive ones, but less than all, of the plural tucking needles and knitting the fourth base yarn and a fourth pile yarn on the remaining needles of the plural tucking needles and sinkers associated therewith and on the selected needles and their associated sinkers. In forming each partial terry fabric course, the base yarn thereof is preferably further tucked on plural successive ones of the needles substantially successively following the selected needles. The plated knitting of the base and pile yarns of each partial terry fabric course is accomplished by feeding such yarns to the particular plural needles and the selected needle on which knitting is to occur and respectively onto basic and raised yarn receiving surfaces on the associated sinkers, the tucking of the base yarn in each instance being accomplished by feeding such yarn to the particular plural needles selected for tucking without clearing from such needles any previously knit yarn thereon and manipulating such plural tucking needles to constrain the another base yarn onto the basic yarn receiving surfaces of the associated sinkers.

By utilizing the method and apparatus of the present invention, an improved knitted tubular hosiery article is produced having a circularly knit contoured portion formed of complete and partial terry fabric courses. Each complete terry fabric course includes a pile and base yarn knit in plated relationship in substantially every wale and each partial terry fabric course includes another pile and base yarn knit in plated relationship in a selected number of substantially successive wales with the another base yarn tucked in at least one wale, preferably plural successive wales, adjacent one side of the selected wales and preferably on each side thereof. In the preferred embodiment, two additional partial terry fabric courses follow each first-described partial terry fabric course. In this manner, the hosiery article has the aforedescribed greater fabric extent along one circumferential portion thereof thereby imposing a fabric curvature that forms the contoured portion.

DESCRIPTION OF THE PREFERRED EMBODIMENT

Figure 1:
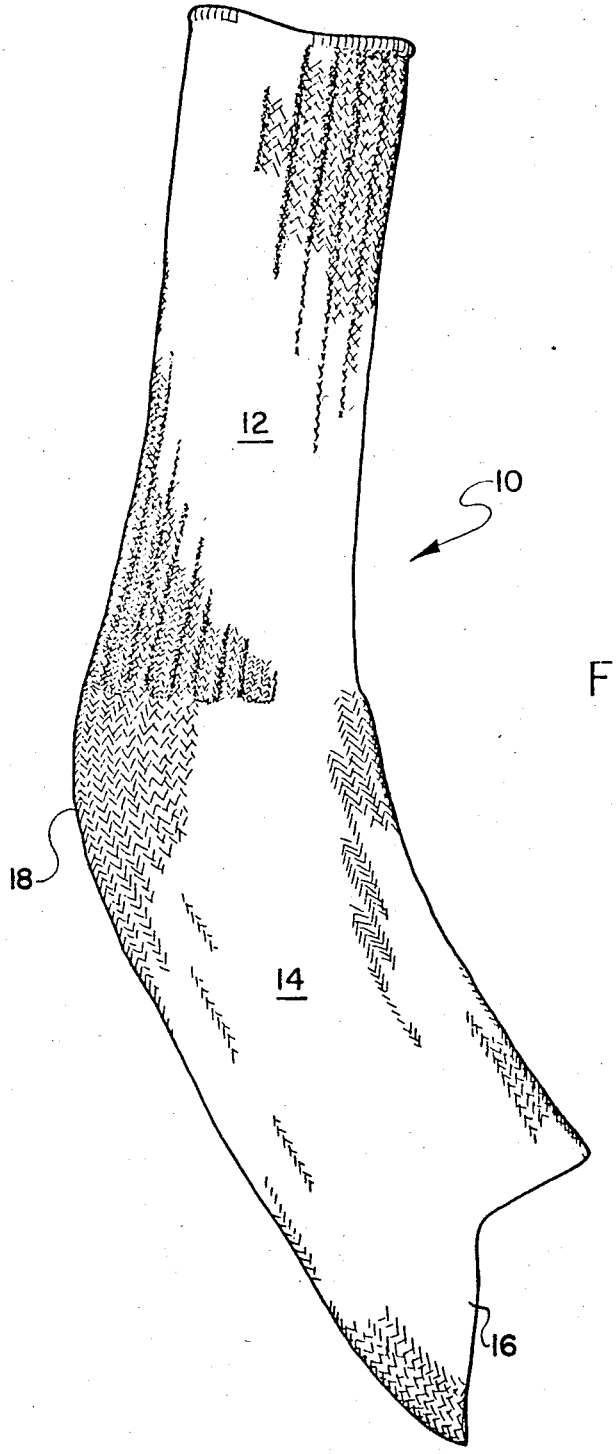
FIG. 1 is a side elevational view of an athletic sock knit according to the present invention.

Referring now to the accompanying drawings, the athletic sock of the present invention is generally illustrated in FIG. 1 at 10 and is of a tubular type construction basically including a leg portion 12 and a foot portion 14. The leg portion 12 may be of any well-known type of construction normally employed in athleic socks, for instance a jersey construction having elastic yarn laid-in on the reverse side thereof by a system of alternate tucks and floats to create an elastic ribbed appearance on the face side of the leg portion 12, as illustrated. The foot portion 14 includes a toe area 16 of the well-known "fish mouth" type, illustrated as knit in its open condition prior to being sewn closed, and a heel area 18, and is knit of a terry-type pile construction to provide a cushion sole. According to the present invention, the toe and heel areas 16, 18 of the foot portion 14 are of a particular novel contoured construction produced according to the method and apparatus of the present invention. Otherwise, the construction of the foot portion 14 is conventional.

The method and apparatus of the present invention are particularly and preferably adapted to a conventional circular knitting machine of the type having a small diameter and coarse needle gauge most often used for knitting heavy weight, athletictype socks. In the preferred embodiment illustrated and described herein, a hosiery knitting machine manufactured by Speizman Industries, Inc., Charlotte, N.C., the assignee hereof, under the model designation AMY IV, is employed. The basic machine and its operation are conventional and known and, therefore, for clarity and succinctness of the illustration and description of the present invention, the machine and its operation are illustrated and described herein only insofar as is necessary to facilitate a complete understanding of the method and apparatus of the present invention. In conventional manner, the machine includes a rotatable needle cylinder (not shown) having axial slots formed in its outer circumferential surface in which are movably carried latch-type knitting needles 20 having a yarn-receiving hook 20' and a closable latch 20'', and a synchronously rotatable sinker ring (also not shown) having radial slots formed therein in which are movably carried loop-forming sinkers 22 disposed annularly and coaxially about the upper edge of the cylinder for movement of the sinkers 22 transversely of and between the needles 20. To facilitate the formation of the terry-type pile construction in the foot portion of the sock 10, the sinkers 22 are of the known terry type having a lower basic yarn receiving surface 22' and an upper raised yarn receiving surface 22'' over which sinker loops and terry pile loops, respectively, may be formed in plated knitting of two yarns. The machine is of the preferred coarse gauge, its cylinder and sinker ring respectively carrying 108 needles and 108 associated sinkers, and is provided with four knitting stations whereby four fabric courses are knit with each rotation of the needle cylinder and sinker ring. Operational manipulation of the needles 20 and sinkers 22 within their respective cylinder and sinker ring slots is accomplished in conventional manner by stationary needle cams 26 and sinker cams 28 disposed adjacent the needle cylinder and sinker ring to engage and act on cam butts 27, 29 formed respectively on the needles 20 and sinkers 22 during rotation of the needle cylinder and sinker ring. (See FIG. 2). A needle jack 24 is movably disposed in each cylinder slot below the needle 20 thereof and a jack selector arrangement (not shown) is disposed adjacent the cylinder slightly in advance of each knitting station to actuate the selective raising of the jacks 24 to act on their associate needles 20 to raise the needles 20 into active position for cammed knitting manipulation thereof at the respective knitting station, as hereinafter more fully described.

At least two yarn feeding fingers 31, 33 (FIG. 2) are pivotably disposed at each knitting station for movement into and out of yarn feeding position to feed yarn to the needles thereat, one yarn feeding finger 31 being adapted to feed a base yarn to the hooks of active, raised needles at a normal level for receipt by the sinkers over their basic yarn receiving surfaces and another yarn feeding finger 33 beng adapted to feed a pile yarn to the hooks of active, raised needles at an elevated level for receipt by the sinkers over their raised yarn receiving surfaces, thereby to facilitate the formation of the terry construction of the foot portion of the athletic sock 10. As will be understood, the knitting operation of the machine proceeds in conventional manner by initially knitting the leg portion followed by the knitting of the foot portion and an appropriate patterning arrangement is provided for controlling the necessary transitional charges in machine operation to form each sock portion and area.

According to a particular feature of the present invention, the knitting of the foot portion 14 of the athletic sock 10 is accomplished by continuously rotating the needle cylinder and sinker ring throughout the knitting operation, even during the formation of the toe and heel areas 16, 18. Conceptually, the present method and apparatus contemplates that immediately following the knitting of the leg portion 12 to the beginning of the formation of the heel area 18 and intermediate the formation of the heel and toe areas 18, 16, all needles and sinkers are active at each knitting station to form a number of successive, complete terry fabric courses as the cylinder and sinker ring rotate, all as is conventional, but, during the formation of the toe and heel areas 16, 18, all needles and sinkers are so active at only one knitting station and at each other knitting station only selected successive needles and associated sinkers disposed in one circumferential side of the cylinder and sinker ring and comprising approximately one-half or slightly less than one-half of all needles and sinkers are active to form three partial, i.e. circumferentially incomplete, terry fabric courses between each complete fabric course as the cylinder and sinker ring rotate. As will be understood, this manner of knitting effectively produces a number of the partial or incomplete courses along one circumferential portion of the sock and creates a greater fabric extent therealong than along the remaining circumferential portion of the sock and thereby imposes a curvature to the fabric to provide the desired contour to the heel and toe areas 16, 18. At each knitting station, the base and pile yarn feeding fingers 31, 33 are operative to feed, respectively, a nylon base yarn and an acrylic pile yarn to form the desired terry cushion sole construction and, according to another particular feature of the present invention, the nylon base yarn is tucked at each of the three knitting stations which form partial courses on certain needles successively preceding and following the selected active needles which knit at such stations. The present invention resides in the method and apparatus by which such formation of the contoured heel and toe areas 18, 16 is accomplished, and in the resultant sock 10, and it is such features of the present invention which will herein be described in detail, all other aspects of the method, apparatus and sock being conventional.

Figure 2:
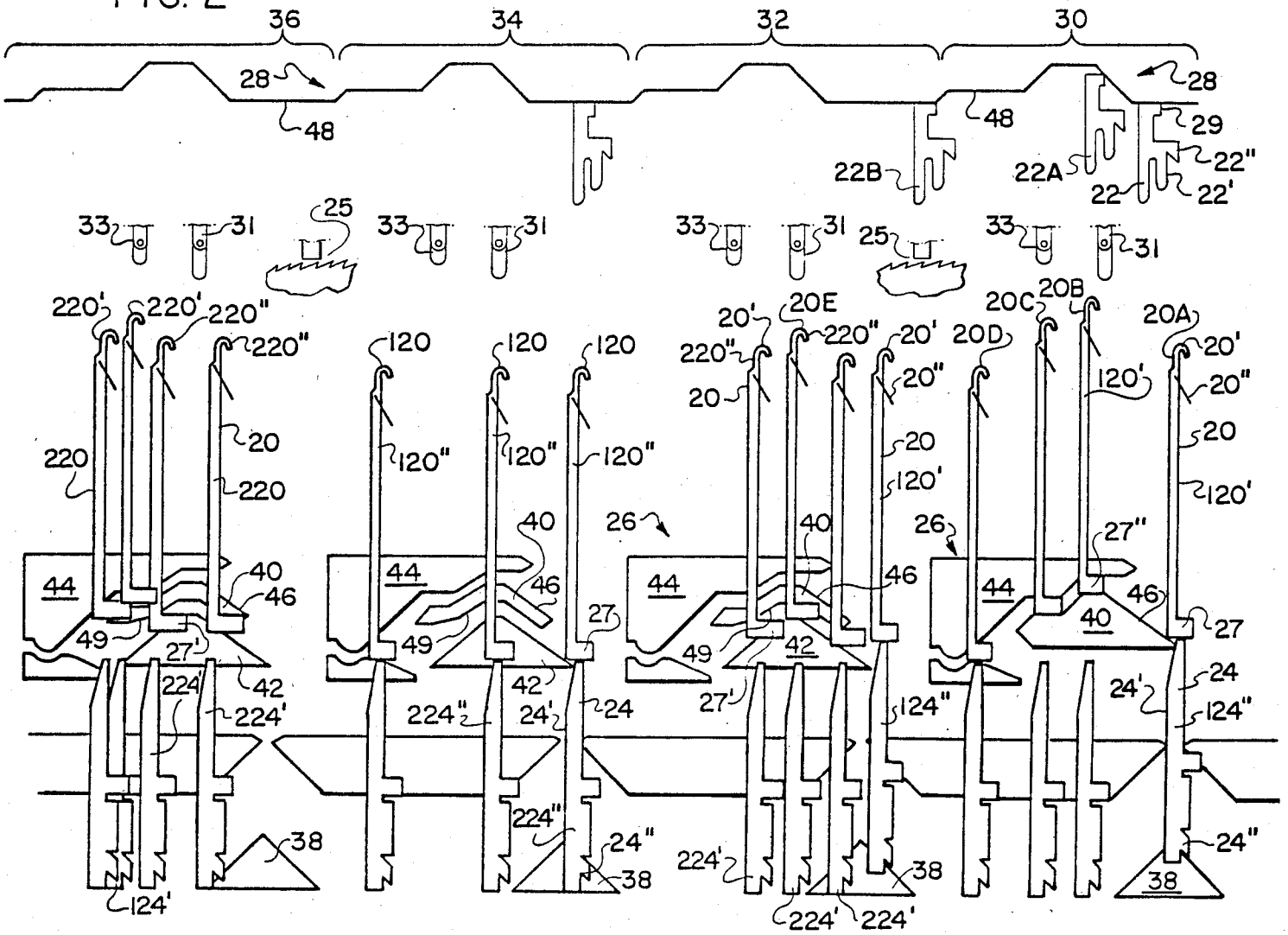
FIG. 2 is a diagrammatic view of the needle and sinker camming arrangements according to the present invention.

Referring now to FIG. 2, a schematic diagram of the needle, needle jack and sinker camming arrangements for the four knitting stations of the present machine are illustrated in their operative condition during formation of the heel and toe areas 18,16, as viewed from the axis of the cylinder and sinker ring, the rotation thereof being understood to cause the needles 20 and sinkers 22 to move in a right-to-left direction as viewed in FIG. 2 and indicated by the directional arrows therein. For convenience, the four knitting stations are generally indicated in FIG. 2 by reference numerals 30, 32, 34, 36 and will hereinafter be referred to respectively as stations I, II, III and IV. According to the particular preferred embodiment of the present method and apparatus, the needle and sinker camming arrangements 26, 28, in conjunction with the jack selector arrangement, are arranged to render operative all 108 needles and all 108 sinkers at station I (30) to form complete terry courses thereat, but to render operative at stations II, III and IV (32, 34, 36) only sixty successive needles and the sixty sinkers associated therewith for forming partial terry courses thereat. In the formation of each partial or incomplete course, certain ones of the rotationally leading and trailing ones of the selected sixty needles function in the aforementioned tucking operation, with the predominant portion of the sixty selected needles therebetween functioning in knitting operation. Thus, of such sixty needles, the nine leading needles and the nine trailing needles at the circumferential ends of the group of sixty needles are designated for selective use in the aforementioned tucking operation, the forty-two remaining needles between each such group of nine tucking needles being active at each of Stations II, II and IV for knitting operation. More specifically, at Station II, each of the eighteen leading and trailing tucking needles is operative for tucking, with the remaining forty-two needles active for knitting; at Station III, only the leading three of the nine leading tucking needles and the trailing three of the nine trailing tucking needles are operative for tucking, the remaining six leading tucking needles, the remaining six trailing tucking needles and the central group of fortytwo needles all being active for knitting; and at Station IV, the leading six of the nine leading tucking needles and the trailing six of the nine trailing tucking needles are operative for tucking, the remaining three leading tucking needles, the remaining three trailing tucking needles and the central group of forty-two needles all being active for knitting. As more fully set forth hereinafter, the tucking operation at each of Stations II, II and IV is accomplished by raising the appropriate tucking needles only to the conventional tuck position such that the latches of such tucking needles engage and are opened by the previously-formed needle loops within the needle hooks but such needle loops do not move below the opened needle latches, at which tuck position the tucking needles are positioned to receive in their hooks the nylon base yarn fed at the normal level by the base yarn feeding fingers.

During the formation of the toe and heel areas 16, 18, the selection of needles for knitting, tucking, and non-knitting, or missing, at the four knitting stations 30, 32, 34, 36 according to the above-described preferred operation of the present invention is accomplished mechanically through the jack selector arrangement and the needle camming arrangements in a conventional manner. As will be understood, each jack 24 is of the conventional type the back edge 24' (i.e. inward of the cylinder) of which is angled slightly to permit each jack to be "rocked" within its cylinder slot so as to cause its outwardly extending cam butt 24" to either project outwardly from the cylinder slot or to be disposed inwardly of the slot. Each jack selector arrangement includes a small pattern drum (not shown) disposed slightly in advance of the needle cams 26 of its knitting station which drum is operable upon associated presser levers selectively to individually engage the jacks 24 in the cylinder to rock them to dispose their cam butts 24" inwardly of their slots or to be out of engagement with the jacks 24 to permit their cam butts 24" to extend outwardly of their slots. A jack raising cam 38 is disposed at each knitting station shortly following each pattern drum and in advance of the needle cams 26 and is arranged at a sufficiently close spacing to the cylinder to be engaged by the outwardly projecting jack cam butts 24" for raising such jacks within their cylinder slots (jacks 124, FIG. 2) but not to be engaged by the cam butts 24" of jacks 24 rocked inwardly within their slots whereby such jacks are not raised (jacks 224', 224", FIG. 2), those jacks 124 raised through this operation of the jack selector arrangement being thusly operative to sufficiently raise their respective needles 20 to a proper starting position (needle 20A, FIG. 2) to engage the clearing cam 40 of the needle cams 26 to be manipulated for knitting at the particular knitting station, as hereinafter described. As those skilled in the art will recognize, the above-described jack selector arrangement is conventional and is therefore not illustrated in the accompanying drawings, it being described hereat for purposes of background information to better facilitate understanding of the present invention. The jack selecting pattern drums of each of the knitting stations 30, 32, 34, 36 are pre-set in conventional manner for the knitting of the toe and heel areas 16, 18 to operate in the above-described manner to raise the jacks 24 of the needles (both tucking needles and ordinary needles) selected to knit at each respective station but not to raise the needles selected to tuck or miss thereat. In order to effect the aforementioned selective raising of the tucking needles for tucking operation at knitting stations II, III, IV (32, 34, 36) each of the eighteen tucking needles is provided with a longer cam butt 27' than the other needles so as to project outwardly of the cylinder a greater distance. In conjunction with this, a special tucking cam 42 is disposed at each of knitting stations II, II, IV (32, 34, 36) at a spacing below the clearing cam 40 thereat and at a spacing outwardly of the cylinder sufficiently to engage the longer butts 27' of tucking needles (needles 20) but to avoid engagement with the normal butts 27'' of other needles 20, the tucking cams 42 being profiled to cause the tucking needles 20 to be raised to an insufficient height to clear the loops therein below the needle latches 20'' and to locate the needles 20 at the tuck position (needle 20E, FIG. 2) for receiving yarn. In this manner, tucking needles may be raised either to an ordinary knit position through selective operation upon their jacks 24 by the jack selector arrangements or to the tuck position through non-operation on their jacks 24 and instead through operation on the longer cam butts 27' of the needles by the tucking cams 42.

Thus, it will be understood that the cylinder is provided with eighteen long butt needles 220 to act as the aforesaid tucking needles and with ninety short butt, or ordinary, needles 120, the eighteen long butt needles 220 being disposed in two groups of nine successively arranged cylinder slots spaced forty-two slots apart and the remaining ninety ordinary needles 120 being disposed in the remaining cylinder slots. The jack selector arrangements are set up such that, when according to the above-defined operational format of the present method and apparatus a tucking needle 220 is to be operative for knitting, its respective jack is raised (needles 220', jacks 124', FIG. 2) such that the tucking needle 220'will be acted on by the needle cams 26, but that, when a tucking needle 220 is to be operative for tucking, its respective jack is not raised (needles 220'', jacks 224') such that the tucking needle 220'' having long butts 27' will be acted on by the tucking cam 42. Further, the jack selector arrangements are set up such that, when an ordinary needle 120 is to be operative to knit, its respective jack is raised (needles 120', jacks 124'') such that the needles 120' will be acted on by the needle cams 26, but that when an ordinary needle 120 is to be out of operation so as to miss, its respective jack is not raised (needles 120'', jacks 224'') such that the needles 120'', having short butts 27'', will not be acted on by any needle cams.

The needle camming arrangement 26 at each knitting station includes a clearing cam 40 and a stitch cam 44, both of which are conventional. The clearing cam 40 is profiled with an upwardly-inclined raising surface 46 disposed to engage the butts of needles 20 raised by the associated preceding jack selector arrangement and to raise such needles 20 to a clearing position (needle 20B, FIG. 2) to cause the needle loops in the hooks of such needles to move below the latches 20'' threof. The stitch cam 44 is disposed following the clearing cam 40 and has a downwardly inclined lowering surface 49 to engage the butts of needles at the clearing position and to lower such needles slightly to the knit position (needle 20C, FIG. 2) for receiving yarn and thereafter to lower such needles to stitching position (needle 20D, FIG. 2) to draw needle loops of the yarn just fed through the previously formed loops just cleared from the needles 20. The tucking cam 42, as above-described, is disposed at a spacing below the clearing cam 40 at stations II, III, IV, and importantly the undersurface of the clearing cam 40 is downwardly inclined to act on the butts of tucking needles to move them downwardly in advance of the stitch cam 44.

The sinker camming arrangement 28 is identical at each knitting station and is conventional. As best seen in FIG. 2, the butts of sinkers 22 move in and are acted on by a cam track 48 so as to cause the sinkers 22 to withdraw radially outwardly from the cylinder and its needles at each knitting station at its location of needle clearing when the needles are in their clearing position (sinker 22A, FIG. 2), and to move radially inwardly toward the cylinder and its needles at each knitting station at the location of the knit position of its needle camming arrangement 26 (sinker 22B, FIG. 2) thereby for formation of sinker and pile loops over the basic and raised sinker surfaces 22', 22'', respectively, as the needles are subsequently cammed downwardly for stitch formation.

Since during the knitting of the toe and heel areas 16, 18, yarn is fed at Stations II, III, IV only to the tucking and selected needles 20 at one side of the needle cylinder and misses the other needles 20 of the cylinder, it is desirable to cut the yarn following each partial course rather than permitting it to float around the remaining circumference of the sock. For this purpose, the knitting machine is provided with a conventional saw-blade cutting knife indicated generally at 25, disposed centrally within the needle cylinder on its dial plate (not shown). In conventional manner, the yarn fed at each of stations II, III, IV extends from the feed fingers thereat to the last needles receiving the yarn and, as such needles continue in their circular path, the yarn is directed into the knife for cutting, the cut yarn end being held in a vacuum holding device (not shown) until knitting thereof begins again.

It will be understood that, in so proceeding at each of stations II, III and IV to cut the respective yarns during each cylinder revolution and then reintroduce the yarns during the next cylinder revolution, there exists the possibility that, if the base and pile yarns are reintroduced in conventional manner to needles at the knit position, the base yarn may not be properly directed onto the basic yarn receiving surfaces 22' of the sinkers 22 but may instead be incorrectly directed onto the raised yarn receiving sinker surfaces 22'' with the pile yarn since the sinkers 22 associated with needles at the knit position are in the process of being cammed inwardly of the needle cylinder. Accordingly, it is exceedingly important that the base and pile yarns be properly re-fed and re-located on the basic and raised sinker surfaces 22', 22'' at each new revolution in order to insure proper plating and pile loop formation and the above-described tucking operation is designed to accomplish this purpose. With reference to FIG. 2, it can be seen that the tucking needles 220'' at the tuck position receive the base yarn from the feed finger 31 at each of Stations II, III, IV and are moved downwardly by the undersurface 49 of the clearing cam 40 while their associated sinkers 22 are withdrawn radially outwardly from the cylinder. Accordingly, the leading tucking needles at each of Stations II, III, IV receive and draw the base yarn over the basic surfaces 22' of their associated sinkers 22 while such sinkers 22 are withdrawn and in advance of any feeding of the base and pile yarns to the following needles at the knit and clearing positions, and this initial action on the base yarn by the leading tucking needles is effective to constrain the base yarn into proper position on the basic surface 22' of each following sinker 22 associated with the selected needles at the knit position and to thereby insure that the base and pile yarns are properly positioned on the basic and raised sinker surfaces 22', 22'' for knitting in the desired plated relationship.

Figure 3:
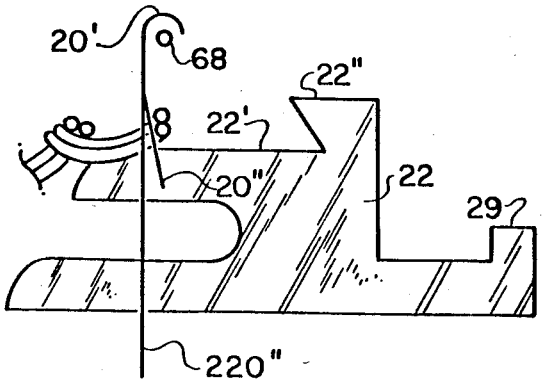
FIGS. 3–6 are schematic views illustrating in side elevation various actions of the needles and sinkers according to the present invention.
Figure 4:
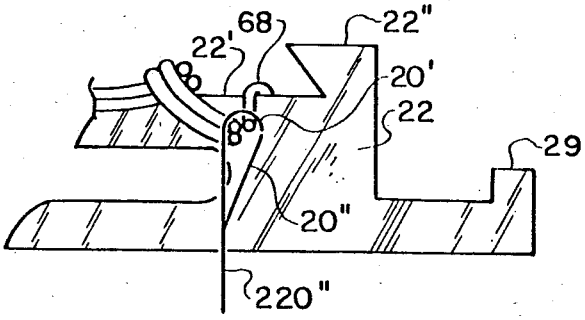
Figure 5:
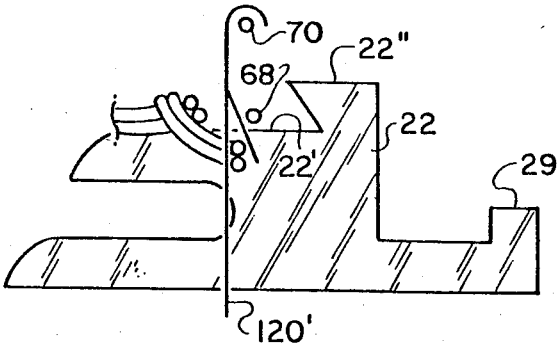
Figure 6:
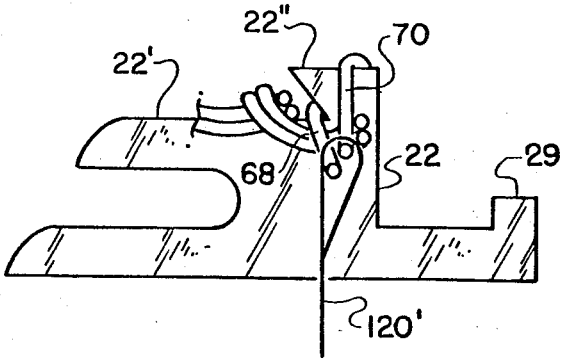

The tucking procedure will be more particularly understood with reference to FIGS. 3–6 wherein there is representatively illustrated sequentially the introduction of a base yarn 68 and a pile yarn 70 at either of Stations II, III, IV following the inactive missing needles thereat. Thus, FIG. 3 illustrates a tucking needle 220'' at the tuck position receiving the base yarn 68 while the associated sinker 22 is withdrawn radially outwardly of the cylinder. FIG. 4 illustrates the same tucking needle 220'' and sinker 22 at a slightly advanced position in the cylinder and sinker ring rotation at the lowermost point to which the needle 220'' is moved downwardly by the undersurface 49 of the clearing cam 40, at which position the needle 220'' has drawn the base yarn 68 over the basic surface 22' of the sinker 22 and the sinker 22 has been moved partially radially inwardly toward the cylinder but not sufficiently for the raised surface 22'' to interfere with the base yarn 68. Assuming that the tucking needle 220'' of FIGS. 3 and 4 is the last leading tucking needle at the particular knitting station, the ordinary needle successively following the needle 220'' will just be reaching the knit position when the tucking needle 220'' is in its disposition of FIG. 4. Such first ordinary needle 120' is illustrated in FIG. 5 at its knit position, its associated sinker 22 being partially moved radially inwardly of the cylinder, and the needle 120' receiving the leading end of the pile yarn 70 at an elevated position above the raised surface 22'' of the associated sinker 22 while the base yarn 68 is constrained onto the basic surface 22' of the sinker 22 under the influence of the preceding tucking needle 220''. Thus, as shown in FIG. 6, when the needles 220'', 120' and their associated sinkers 22 have advanced further in the cylinder and sinker ring rotation to a point at which the needle 120' reaches its lowermost stitch postion and its sinker 22 has moved radially inwardly of the cylinder, the base yarn 68 is constrained to remain on the basic surface 22' while the pile yarn 70 is drawn by the needle 120' over the raised surface 22'' to initiate proper plating and, as those skilled in the art will recognize, such direction of the base and pile yarns will continue throughout the remainder of the knitting of the particular partial course at the particular knitting station. Thus, it will be understood that this tucking procedure importantly guarantees that proper terry-type plated knitting is accomplished on each selected needle at the knit position and each associated sinker at each knitting station II, III, IV throughout the knitting of the toe and heel areas 16, 18.

Those skilled in the art will recognize that the aforedescribed tucking procedure may be effectively accomplished for the intended purpose by providing only one leading tucking needle at each of stations II, III, IV. In the preferred form of the present invention, nine leading tucking needles are provided and are selectively employed in multiples of three as previously described to best insure the desired constraint of the base yarns as well as to provide a better appearance to the resultant sock in that a smoother appearing transition in the fabric curvature is provided and there is reduced bulk from the tucked yarns. The use of corresponding trailing tucking needles following the selected knitting needles will also be recognized to be unnecessary under the present invention but is considered highly desirable for purposes of enhanced uniformity of the construction and appearance of the resultant sock.

Figure 7:
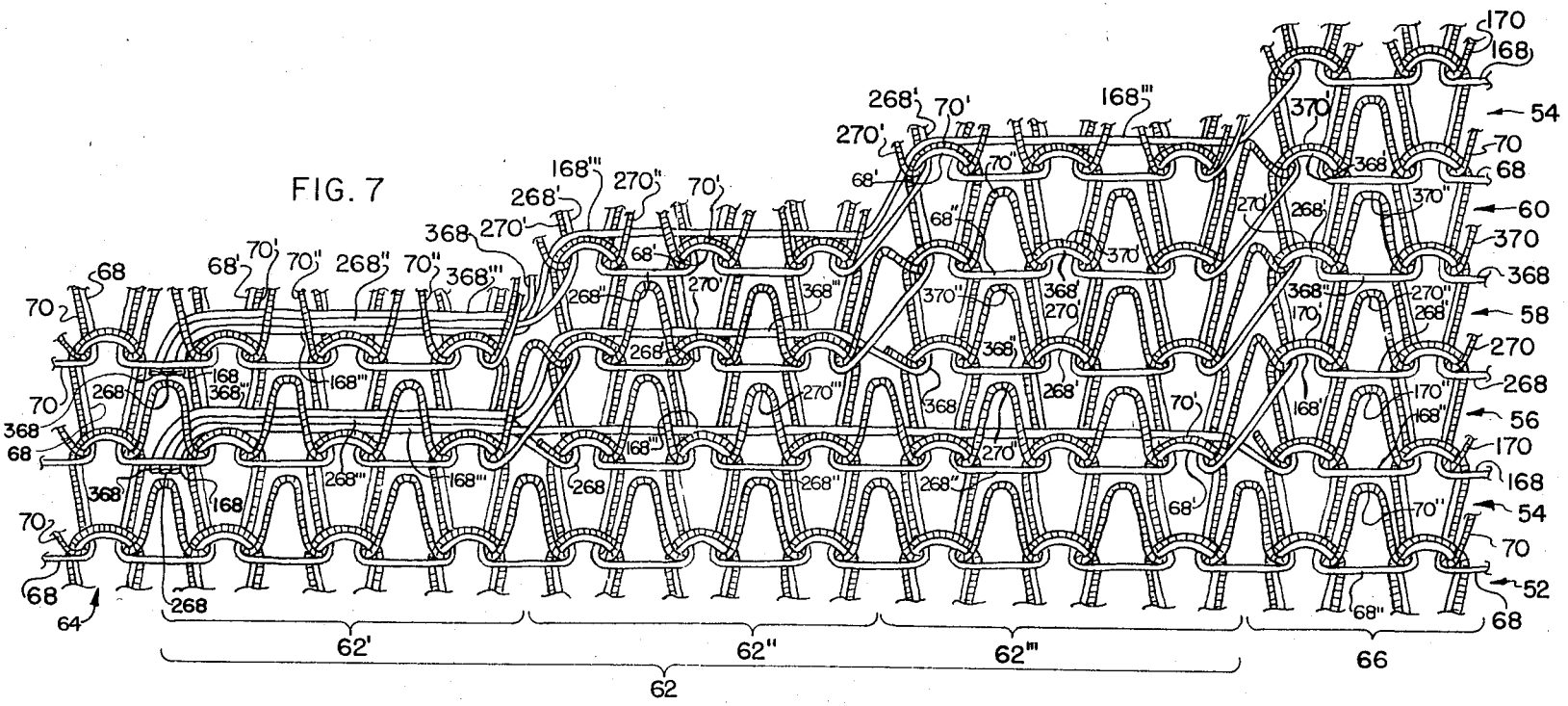
FIG. 7 is a schematic view of the reverse side of the athletic sock of FIG. 1 at the contoured portion thereof.

The construction of the resultant knitted fabric of the toe and heel areas 16, 18 produced according to the above-described method and apparatus of the present invention is best seen in and understood from FIG. 7 wherein the reverse or inward side of the fabric is illustrated diagrammatically. It will be understood that the fabric is knit in loops extending in circumferential courses and axial wales, as is conventional, there being a course knit by each knitting station for each complete cylinder revolution and a wale knit by each needle in the cylinder, providing a total of 108 wales. In FIG. 7, the last complete circumferential course of the foot portion 14 preceding the heel area 18 (or the last complete foot portion course preceding the toe area 16), indicated at 52, and the first four circumferential courses of the heel area 18 (or toe area 16), indicated at 54, 56, 58, 60, respectively, are illustrated across the twelve axial wales which include the nine leading wales of the nine leading tucking needles, indicated at 62, one preceding wale, indicated at 64, and two succeeding wales, indicated at 66. Thus, course 52 represents the last complete course preceding the heel and toe areas 18, 16, knit at Station IV and courses 54, 56, 58, 60 represent the first four courses of the heel and toe areas 16, 18 knit at Stations I, II, III, IV, respectively. As will be understood, the opposite side of the heel and toe areas 18, 16 are of identical, but mirrorimage, construction with all wales 66 intermediate thereof being identical to wales 66 and all other wales of the heel and toe areas 18, 16 being identical to wale 64.

As previously indicated, the initial courses of the foot portion 14 following the leg portion 12 and the courses of the foot portion 14 intermediate the heel and toe portions 18, 16, such as course 52, are complete knit terry courses in that a base yarn 68 and a pile yarn 70 are knit in plated relationship in plated needle loops 68', 70' in each of the 108 wales of the fabric and in base yarn sinker loops 68'' and in pile loops 70'' between each wale. Likewise, course 54 and every fourth course thereafter throughout the heel and toe areas 18, 16, all being knit at Station I, are also complete terry fabric courses. However, courses 56, 58, 60, and every fourth course after each thereof in the heel and toe area 18, 16, being knit respectively by Stations II, III, IV, are partial terry fabric courses, i.e. circumferentially incomplete or part-courses, in that each such course spans only sixty wales with a base yarn and a pile yarn knit in plated relation in plated needle loops only in a selected number of successive wales and in base yarn sinker loops and pile loops between such wales and with the respective base yarn tucked only in certain adjacent wales. More specifically, incomplete course 56 and every fourth course thereafter in the heel and toe areas 18, 16, includes a base yarn 168 tucked at 168' with the preceding course 54 across the nine leading wales 62 of the nine leading tucking needles and the corresponding nine trailing wales (not shown) of the nine trailing tucking needles and includes a pile yarn 170 knit platingly with the base yarn 168 in needle loops 168', 170' in the forty-two intermediate wales 66 of the forty-two needles selected to knit at Station II and in base yarn sinker loops 168″ and in pile loops 170″ between such wales 66. Course 58 and every fourth course thereafter in the heel and toe area 18, 16, includes a base yarn 268 tucked at 268′ with the course 54 across the leading three wales 62′ of the nine leading wales 62 and the corresponding three trailing wales (not shown) of the nine trailing wales and includes a pile yarn 270 knit platingly with the base yarn 268 in needle loops 268′, 270′ in the other six leading wales 62″ and 62‴, in the other six trailing wales, and in the forty-two wales 66 and in base yarn sinker loops 268″ and pile loops 270″ between such knitted wales. Course 60 and every fourth course thereafter in the heel and toe area 18, 16, includes a base yarn 368 tucked at 368‴ with the course 54 across the leading three wales 62′ and the corresponding three trailing wales and with the preceding course 58 across the intermediate three wales 62″ of the nine leading wales 62 and the corresponding intermediate three trailing wales (not shown), and includes a pile yarn 370 knit platingly with the base yarn 368 in needle loops 368′, 370′ in the other three leading wales 62‴, in the other three trailing wales, and in the forty-two wales 66 and in base yarn sinker loops 368″ and pile loops 370″ between such knitted wales. As will be understood, the continued successive alternation of a complete fabric course and three partial fabric courses produces a greater number of courses and a greater fabric extent along one circumferential side of the resultant sock which effectively imposes a curvature to the fabric along the length of the sock and thereby provides the desired contour for the heel and toe areas 18, 16.

Advantageously, the present method and apparatus uniquely provide for the formation of the above-described novel contoured terry fabric construction by rotary rather than conventional reciprocatory cylinder motion which facilitates the knitting of the sock 10 by continuous, uninterrupted rotation of the needle cylinder. As a result, the production efficiency of the knitting machine within the confines of the style, pattern and other variable characteristics of the sock or other terry hosiery article being knitted can be best maximized and realized. Particularly, the elimination of the necessity of slower reciprocatory knitting provides significant time savings not only in the reduction of the actual knitting time but also in the elimination of the special machine preparation necessary for reciprocatory knitting. Ultimately, the present invention provides for the knitting of tubular athletic socks and similar terry fabric hosiery articles with a contoured heel and toe area at little or no significant cost difference over conventional non-contoured tube-type socks and hosiery.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. In a method of knitting a tubular hosiery article of terry fabric having yarn formed in needle, sinker and terry loops extending in circumferential courses and axial wales, said knitting method being performed on a circular knitting machine having respective circles of movable knitting needles and sinkers cooperatively arranged in assocciation for relative knitting movement, each of said sinkers being of the type having a basic sinker loop forming surface and a raised terry loop forming surface spaced therefrom, the improvement comprising rotationally operating said knitting machine to knit an axially contoured terry fabric portion of said hosiery article by progressively repeating the steps of:

(a) forming a circumferentially complete course of terry fabric in substantially all said wales of said hosiery article to extend fully circumferentially thereabout, said forming said complete course including:

(1) feeding one base yarn and one pile yarn to substantially all said needles and associated sinkers, and (2) manipulating said substantially all said needles and associated sinkers to knit said one base and pile yarns in needle loops of each thereof in plated relationship on said substantially all said needles, in sinker loops of said one base yarn on the basic sinker loop forming surfaces of the associated sinkers, and in elongated terry loops of said one pile yarn on said raised terry loop forming surfaces of the associated sinkers; and (b) forming a first circumferentially incomplete course of terry fabric extending only partially circumferentially about said hosiery article, said first incomplete course having another base yarn in only a selected substantially successively arranged partial number of said wales of said hosiery article and terminating at the adjacent nonselected wales and having another pile yarn in only a predominant portion of said selected wales and terminating at the adjacent selected wales, said forming said first incomplete course including:

(1) feeding said another base yarn to only a selected substantially successively arranged partial number of said needles and to sinkers associated therewith by feeding a leading end of said another base yarn initially to at least one leading needle of said selected needles and the associated at least one leading sinker and feeding the trailing length of said another base yarn thereafter to the other said selected needles and sinkers associated therewith, (2) feeding said another pile yarn to only a predominant portion of said other selected needles successively following said at least one leading needle and to sinkers associated therewith by feeding a leading end of said another pile yarn initially to a leading one of said predominant portion of said other selected needles and feeding the trailing length of said another pile yarn thereafter to the remaining ones of said predominant portion of said other selected needles and sinkers associated therewith, (3) tucking said leading end of said another base yarn on said at least one leading needle of said selected needles and manipulating said at least one leading needle to draw said leading end of said another base yarn onto said basic sinker loop forming surface of the associated at least one leading sinker in advance of said feeding said another pile yarn, (4) manipulating said predominant portion of said other selected needles and sinkers associated therewith to knit said trailing length of said another base yarn and said leading end and trailing length of said another pile yarn in needle loops of each thereof in plated relationship on said predominant portion of said other selected needles, in sinker loops of said another base yarn on the basic sinker loop forming surfaces of the associated sinkers and in elongated terry loops of said another pile yarn on said raised terry loop forming surfaces of the associated sinkers, and (5) cutting said trailing length of said another base yarn following the trailing one of said selected needles and cutting said trailing length of said another pile yarn following the trailing one of said predominant portion of said other selected needles, (6) said tucking said at least one leading end of said another base yarn and said manipulating said at least one leading needle constraining said trailing length of said another base yarn onto said basic sinker loop forming surfaces of the sinkers successively following said at least one leading sinker to prevent accidental positioning of said another base yarn on said raised terry loop forming surfaces thereof for achieving distinct formation of said sinker loops with said another base yarn and of said terry loops with said another pile yarn, whereby a number of said first incomplete courses are produced along one circumferential portion of said hosiery article to create a greater axial fabric extent therealong than along the remaining circumferential portion of said hosiery article to impose a fabric curvature that forms said contoured portion.

2. The improvement in a method of knitting a tubular hosiery article according to claim 1 and characterized further in that said predominant portion of said other selected needles excludes at least one trailing needle of said selected needles, said forming said first incomplete terry fabric course including further tucking said trailing length of said another base yarn on said at least one trailing needle of said selected needles.

3. The improvement in a method of knitting a tubular hosiery article according to claim 2 and characterized further in that said at least one leading needle comprises plural successive leading ones of said selected needles and said predominant portion of said selected needles comprises no greater than approximately one-half of said circle needles.

4. The improvement in a method of knitting a tubular hosiery article according to claim 1 and characterized further by, following said forming said first incomplete terry fabric course and in advance of said forming the next successive complete terry fabric course, forming with said selected needles a second circumferentially incomplete course of terry fabric extending correspondingly with said first incomplete course only partially circumferentially about said hosiery article, said second incomplete course having a third base yarn in only said selected wales of said hosiery article and terminating at the adjacent non-selected wales and having a third pile yarn in only a second predominant portion of said selected wales and terminating at the adjacent selected wales.

5. The improvement in a method of knitting a tubular hosiery article according to claim 4 and characterized further in that said forming said second incomplete terry fabric course incudes tucking a leading end of said third base yarn on a different number of at least one leading needle of said selected needles than said at least one leading needle utilized in said forming said first incomplete terry fabric course, knitting the trailing length of said third base yarn and a leading end and trailing length of said third pile yarn in plated relationship on a second predominant portion of the other selected needles and associated sinkers successively following said different number of at least one leading needle, and cutting said trailing length of said third base yarn following the trailing one of said selected needles and cutting said trailing length of said third pile yarn following the trailing one of said second predominant portion of said other selected needles.

6. The improvement in a method of knitting a tubular hosiery article according to claim 5 and characterized further in that said predominant portion of the other selected needles following said different number of at least one leading needle excludes at least one trailing needle of said selected needles, said forming said second incomplete terry fabric course including further tucking said trailing length of said third base yarn on said at least one trailing needle of said selected needles.

7. The improvement in a method of knitting a tubular hosiery article according to claim 4 and characterized further by, following said forming said second incomplete terry fabric course and in advance of said forming the next successive complete terry fabric course, forming with said selected needles a third circumferentially incomplete course of terry fabric extending correspondingly with said first and second incomplete courses only partially circumferentially about said hosiery article, said third incomplete course having a fourth base yarn in only said selected wales of said hosiery article and terminating at the adjacent non-selected wales and having a fourth pile yarn in only a third predominant portion of said selected wales and terminating at the adjacent selected wales.

8. The improvement in a method of knitting a tubular hosiery article according to claim 7 and characterized further in that said forming said third incomplete terry fabric course includes tucking a leading end of said fourth base yarn on another different number of at least one leading needle of said selected needles than said at least one leading needles utilized in said forming said first and second incomplete courses, knitting the trailing length of said fourth base yarn and a leading end and trailing length of said fourth pile yarn in plated relationship on a third predominant portion of the other selected needles and associated sinkers successively following said another different number of at least one leading needle, and cutting said trailing length of said fourth base yarn following the trailing one of said selected needles and cutting said trailing length of said fourth pile yarn following the trailing one of said third predominant portion of said other selected needles.

9. The improvement in a method of knitting a tubular hosiery article according to claim 8 and characterized further in that said predominant portion of the other selected needles following said another different number of at least one leading needle excludes at least one trailing needle of said selected needles, said forming said third incomplete terry fabric course including further tucking said trailing length of said fourth base yarn on said at least one trailing needle of said selected needles.

10. The improvement in a method of knitting a tubular hosiery article according to claim 5 and characterized further by, following said forming said second incomplete terry fabric course and in advance of said forming the next successive complete terry fabric course, forming with said selected needles a third circumferentially incomplete course of terry fabric extending correspondingly with said first and second incomplete courses only partially circumferentially about said hosiery article, said third incomplete course having a fourth base yarn in only said selected wales of said hosiery article and terminating at the adjacent non-selected wales and having a fourth pile yarn in only a third predominant portion of said selected wales and terminating at the adjacent seelcted wales, said forming said third incomplete terry fabric course including tucking a leading end of said fourth base yarn on another different number of at least one leading needle of said selected needles than said at least one leading needles utilized in said forming said first and second incomplete courses, knitting the trailing length of said fourth base yarn and a leading end and trailing length of said fourth pile yarn in plated relationship on a third predominant portion of the other selected needles and associated sinkers successively following said another different number of at least one leading needle, and cutting said trailing length of said fourth base yarn following the trailing one of said selected needles and cutting said trailing length of said fourth pile yarn following the trailing one of said third predominant portion of said other selected needles.

11. The improvement in a method of knitting a tubular hosiery article according to claim 10 and characterized further in that said at least one leading needle utilized in said forming said first incomplete terry fabric course comprises plural successive leading ones of said selected needles, in that said different number of at least one leading needle utilized in said forming said second incomplete terry fabric course comprises selected leading ones of said plural leading needles, and in that said another different number of at least one leading needles utilized in said forming said third incomplete terry fabric course comprises said selected leading ones of said plural leading needles and successive additional ones but less than all of said plural leading needles.

12. The improvement in a method of knitting a tubular hosiery article according to claim 11 and characterized further in that said predominant portion of the other selected needles utilized in said first incomplete terry fabric course excludes plural successive trailing ones of said selected needles, said forming said first incomplete terry fabric course including further tucking said trailing length of said another base yarn on said plural trailing needles; characterized further in that said predominant portion of the other selected needles following said different number of at least one leading needle utlized in said forming said second incomplete terry fabric course excludes selected successive trailing ones of said plural trailing needles, said forming said second incomplete terry fabric course including further tucking said trailing length of said third base yarn on said selected trailing ones of said plural trailing needles; and characterized further in that said predominant portion of the other selected needles following said another different number of at least one leading needle utilized in said forming said third incomplete terry fabric course excludes said selected trailing ones of said plural trailing needles and successively preceding additional ones but less than all of said plural trailing needles, said forming said third incomplete terry fabric course including further tucking said trailing length of said fourth base yarn on said selected and additional ones of said plural trailing needles.

13. The improvement in a method of knitting a tubular hosiery article according to claim 12 and characterized further in that each of said predominant portion of the other selected needles utilized in said forming said first incomplete terry fabric course, said predominant portion of the other selected needles utilized in said forming said second incomplete terry fabric course and said predominant portion of the other selected needles utilized in said forming said third incomplete terry fabric course comprise no greater than approximately one-half of said circle of needles.

14. In a circular knitting machine for knitting a tubular hosiery article of terry fabric having yarn formed in needle, sinker and terry loops extending in circumferential courses and axial wales, said machine being of the type having respective circles of movable knitting needles and sinkers cooperatively arranged in association for relative knitting movement, each of said sinkers being of the type having a basic sinker loop forming surface and a raised terry loop forming surface spaced therefrom, the improvement comprising means for rotationally operating said knitting machine to knit an axially contoured terry fabric portion of said hosiery including:

(a) means for forming a circumferentially complete course of terry fabric in substantially all said wales of said hosiery article to extend fully circumferentially thereabout, said complete course forming means including:

(1) means for feeding one base yarn and one pile yarn to substantially all said needles and associated sinkers, and (2) means for manipulating said substantially all said needles and associated sinkers to knit said one base and pile yarns in needle loops of each thereof in plated relationship on said substantially all said needles, in sinker loops of said one base yarn on the basic sinker loop forming surfaces of the associated sinkers, and in elongated terry loops of said one pile yarn on said raised terry loop forming surfaces of the associated sinkers; and (b) means for forming a first circumferentially incomplete course of terry fabric extending only partially circumferentially about said hosiery article, said first inomplete course having another base yarn in only a selected substantially succively arranged partial number of said wales of said hosiery article and terminating at the adjacent non-selected wales and having another pile yarn in only a predominant portion of said selected wales and terminating at the adjacent selected wales, said first incomplete course forming means including:

(1) means for feeding said another base yarn to only a selected substantially successively arranged partial number of said needles and to sinkers associated therewith by feeding a leading end of said another base yarn initially to at least one leadng needle of said selected needles and the associated at least one leading sinker and feeding the trailing length of said another base yarn thereafter to the other said selected needles and sinkers associated therewith, (2) means for feeding said another pile yarn to only a predominant portion of said other selected needles successively following said at least one leading needle and to sinkers associated therewith by feeding a leading end of said another pile yarn initially to a leading one of said predominant portion of said other selected needles and feeding the trailing length of said another pile yarn thereafter to the remaining ones of said predominant portion of said other selected needles and sinkers associated therewith, (3) means for tucking said leading end of said another base yarn on said at least one leading needle of said selected needles and for manipulating said at least one leading needle to draw said leading end of said another base yarn onto said basic sinker loop forming surface of the associated at least one leading sinker in advance of said feeding said another pile yarn, (4) means for manipulating said predominant portion of said other selected needles and sinkers associated therewith to knit said trailing length of said another base yarn and said leading end and trailing length of said another pile yarn in plated relationship on said predominant portion of said other selected needles, in sinker loops of said another base yarn on the basic sinker loop forming surfaces of the associated sinkers and in elongated terry loops of said another pile yarn on said raised terry loop forming surfaces of the associated sinkers, and (5) means for cutting said trailing length of said another base yarn following the trailing one of said selected needles and for cutting said trailing length of said another pile yarn following the trailing one of said predominant portion of said other selected needles, (6) said tucking and manipulating means being effective for constraining said trailing length of said another base yarn onto said basic sinker loop forming surfaces of the sinkers successively following said at least one leading sinker to prevent accidental positioning of said another base yarn on said raised terry loop forming surfaces thereof for achieving distinct formation of said sinker loops with said another base yarn and of said terry loops with said another pile yarn, thereby for producing a number of said first incomplete courses along one circumferential portion of said hosiery article to create a greater axial fabric extent therealong than along the remaining circumferential portion of said hosiery article to impose a fabric curvature that forms said portion.

15. The improvement in a circular knitting machine according to claim 14 and characterized further in that said predominant portion of said other selected needles excludes at least one trailing needle of said selected needles, said first incomplete course forming means including means for further tucking said trailing length of said another base yarn on said at least one trailing needle of said selected needles.

16. The improvement in a circular knitting machine according to claim 15 and characterized further in that said at least one leading needle comprises plural successive leading ones of said selected needles and said predominant portion of said selected needles comprises no greater than approximately onehalf of said circle of needles.

17. The improvement in a circular knitting machine according to claim 14 and characterized further by means for forming with said selected needles a second circumferentially incomplete course of terry fabric extending correspondingly with said first incomplete course only partially circumferentially about said hosiery article, said second incomplete course having a third base yarn in only said selected wales of said hosiery article and terminating at the adjacent non-selected wales and having a third pile yarn in only a second predominant portion of said selected wales and terminating at the adjacent selected wales.

18. The improvement in a circular knitting machine according to claim 17 and characterized further in that said second incomplete course forming means includes means for tucking a leading end of said third base yarn on a different number of at least one leading needle of said selected needles than said at least one leading needle utilized by said first incomplete course forming means, means for knitting the trailing length of said third base yarn and a leading end and trailing length of said third pile yarn in plated relationship on a second predominant portion of the other selected needles and associated sinkers successively following said different number of at least one leading needle, and means for cutting said trailing length of said third base yarn following the trailing one of said selected needles and for cutting said trailing length of said third pile yarn following the trailing one of said second predominant portion of said other selected needles.

19. The improvement in a circular knitting machine according to claim 18 and characterized further in that said predominant portion of the other selected needles following said different number of at least one leading needle excludes at least one trailing needle of said selected needles, said second incomplete course forming means including means for further tucking said trailing length of said third base yarn on said at least one trailing needle of said selected needles.

20. The improvement in a circular knitting machine according to claim 17 and characterized further by means for forming with said selected needles a third circumferentially incomplete course of terry fabric extending correspondingly with said first and second incomplete courses only partially circumferentially about said hosiery article, said third incomplete course having a fourth base yarn in only said selected wales of said hosiery article and terminating at the adjaacent non-selected wales and having a fourth pile yarn in only a third predominant portion of said selected wales and terminating at the adjacent selected wales.

21. The improvement in a circular knitting machine according to claim 20 and characterized further in that said third incomplete course forming means includes means for tucking a leading end of said fourth base yarn on another different number of at least one leading needle of said selected needles than said at least one leading needles utilized by said first and second incomplete course forming means, means for knitting the trailing length of said fourth base yarn and a leading end and trailing length of said fourth pile yarn in plated relationship on a third predominant portion of the other selected needles and associated sinkers successively following said another different number of at least one leading needle, and means for cutting said trailing length of said fourth base yarn following the trailing one of said selected needles and for cutting said trailing length of said fourth pile yarn following the trailing one of said third predominant portion of said other selected needles.

22. The improvement in a circular knitting machine according to claim 21 and characterized further in that said predominant portion of the other selected needles following said another different number of at least one leading needle excludes at least one trailing needle of said selected needles, said third incomplete course forming means including means for further tucking said trailing length of said fourth base yarn on said at least one trailing needle of said selected needles.

23. The improvement in a circular knitting machine according to claim 18 and characterized further by means for forming with said selected needles a third circumferentially incomplete course of terry fabric extending correspondingly with said first and second incomplete courses only partially circumferentially about said hosiery article, said third incomplete course having a fourth base yarn in only said selected wales of said hosiery article and terminating at the adjacent non-selected wales and having a fourth pile yarn in only a third predominant portion of said selected wales and terminating at the adjacent selected wales, said third incomplete course forming means including means for tucking a leading end of said fourth base yarn on another different number of at least one leading needle of said selected needles than said at least one leading needles utilized by said first and second incomplete course forming means, means for knitting the trailing length of said fourth base yarn and a leading end and trailing length of said fourth pile yarn in plated relationship on a third predominant portion of the other selected needles and associated sinkers successively following said another different number of at least one leading needle, and means for cutting said trailing length of said fourth base yarn following the trailing one of said selected needles and for cutting said trailing length of said fourth pile yarn following the trailing one of said third predominant portion of said other selected needles.

24. The improvement in a circular knitting machine according to claim 23 and characterized further in that said at least one leading needle utilized by said first incomplete course forming means comprises plural successive leading ones of said selected needles, in that said different number of at least one leading needle utilized by said second incomplete course forming means comprises selected leading ones of said plural leading needles, and in that said another different number of at least one leading needle utilized by said third incomplete course forming means comprises said selected leading ones of said plural leading needles and successive additional ones but less than all of said plural leading needles.

25. The improvements in a circular knitting machine according to claim 24 and characterized further in that said predominant portion of the other selected needles utilized by said first incomplete course forming means excludes plural successive trailing ones of said selected needles, said first incomplete course forming means including means for further tucking said trailing length of said another base yarn on said plural trailing needles; characterized further in that said predominant portion of the other selected needles following said different number of at least one leading needle utilized by said second incomplete course forming means excludes selected successive trailing ones of said plural trailing needles, said second incomplete course forming means including means for further tucking said trailing length of said third base yarn on said selected trailing ones of said plural trailing needles; and characterized further in that said predominant portion of the other selected needles following said another different number of at least one leading needle utilized by said third incomplete course forming means excludes said selected trailing ones of said plural trailing needles and successively preceding additional ones but less than all of said plural trailing needles, said third incomplete course forming means including means for further tucking said trailing length of said fourth base yarn on said selected and additional one of said plural trailing needles.

26. The improvement in a circular knitting machine according to claim 25 and characterized further in that each of said predominant portion of the other selected needles utilized by said first incomplete course forming means, said predominant portion of the other selected needles utilized by said second incomplete course forming means and said predominant portion of the other selected needles utilized by said third incomplete terry course forming means comprise no greater than approximately one-half of said circle of needles.

* * * * *

UNITED STATES PATENT OFFICE

CERTIFICATE OF CORRECTION

Patent No. 4,589,267 Dated May 20, 1986

Inventor(s) Jack C. Barbee

It is certified that error appears in the above-identified patent and that said Letters Patent are hereby corrected as shown below:

Col. 1, Line 62, delete "cusion" and insert therefor — cushion — .
Col. 2, Line 33, delete "onehalf" and insert therefor — one-half — .
Col. 3, Line 56, delete "athletictype" and insert therefor — athletic-type —.
Col. 10, LIne 61, delete "168' " after "tucked at" and insert therefor — 168''' — .
Col. 11, Line 2, delete "Course 58" and insert therefor — Incomplete course 58 — .
Col. 11, Line 12, delete "Course 60" and insert therefor — Incomplete course 60 — .
Col. 11, Line 4, delete "268' " and insert therefor — 268''' — .
Col. 11, Line 26, delete "partial" and insert therefor — circumferentially incomplete — .
Col. 13, Line 43, delete "circle needles" and insert therefor — circle of needles — .
Col. 15, Line 6, delete "seelcted" and insert therefor — selected — .
Col. 15, Line 40, after "utilized in" insert — said forming — .
Col. 16, Line 42, delete "inomplete" and insert therefor — incomplete — .

UNITED STATES PATENT OFFICE

CERTIFICATE OF CORRECTION

Patent No. 4,589,267 Dated May 20, 1986

Inventor(s) Jack C. Barbee

It is certified that error appears in the above-identified patent and that said Letters Patent are hereby corrected as shown below:

Col. 17, Line 44, after "said" insert — contoured — .
Col. 17, Line 58, delete "onehalf" and insert therefor — one-half — .
Col. 18, Line 39, delete "adjaacent" and insert therefor — adjacent — .
Col. 20, Line 4, delete "improvements" and insert therefor — improvement — .

Signed and Sealed this

Fifteenth Day of March, 1988

*Attest:*

DONALD J. QUIGG

*Attesting Officer*

*Commissioner of Patents and Trademarks*